US006052827A

United States Patent [19]

Widdemer

[11] Patent Number: 6,052,827

[45] Date of Patent: Apr. 25, 2000

[54] VIBRATION REDUCING SPORTS GLOVE

[75] Inventor: John D. Widdemer, Gloversville, N.Y.

[73] Assignee: Bali Leathers, Inc., Johnstown, N.Y.

[21] Appl. No.: 09/130,684

[22] Filed: Aug. 6, 1998

[51] Int. Cl.[7] ..... A41D 19/00

[52] U.S. Cl. ..... 2/161.1; 2/16; 2/161.3

[58] Field of Search ..... 2/16, 159, 161.1, 2/161.2, 161.3, 161.5, 161.6, 164, 161.4

[56] References Cited

U.S. PATENT DOCUMENTS

| | | | |
|---|---|---|---|
| 4,329,741 | 5/1982 | Bach | 2/161 |
| 4,590,625 | 5/1986 | Keim | 2/161 |
| 4,624,016 | 11/1986 | Luevano | 2/161 |
| 4,748,690 | 6/1988 | Webster | 2/19 |
| 5,557,803 | 9/1996 | Granich et al. | 2/16 |
| 5,581,809 | 12/1996 | Mah | 2/20 |
| 5,632,045 | 5/1997 | Chase et al. | 2/161.6 |
| 5,697,104 | 12/1997 | Welton | 2/159 |

FOREIGN PATENT DOCUMENTS

| | | | |
|---|---|---|---|
| 1625390 | 1/1991 | Russian Federation | 2/16 |

*Primary Examiner*—Diana Oleksa
*Assistant Examiner*—Katherine Moran
*Attorney, Agent, or Firm*—Aufrichtig Stein & Aufrichtig, P.C.; Peter D. Aufrichtig

[57] ABSTRACT

A vibration reducing sports glove. The glove includes a palm panel for covering the inner portion of a wearer's hands and fingers, thumb panel for covering the wearer's thumb, coupled to the palm panel, and a back panel for covering the outer portion of a wearer's hand and fingers. Vibration reducing pads are coupled to the interior of the glove in critical locations for reducing the degree of vibration. As a result, a vibration reducing sports glove provides a reduction in the vibration and shock transmitted to the wearer's hand at the time a shock or vibration is applied to the outer surface of the glove.

18 Claims, 5 Drawing Sheets

VIBRATION REDUCING SPORTS GLOVE

BACKGROUND OF THE INVENTION

The invention is generally directed to the design of gloves and, in particular, to an improved sport glove which will reduce the vibration, shock and jarring present in many sports.

Players of sports in which there is a moment of impact between a club, bat or racquet with a ball incur violent vibrations that are transmitted through their hands and up their arms. For people suffering from "tennis elbow", "golfer's elbow", arthritis, carpal tunnel syndrome and other afflictions of the joints, tendons, muscles and bones, these vibrations and shock can be excruciatingly painful, can create further damage and can even cause them to abandon their sport.

For example, many older golfers cannot play a full game because of their disabilities and have a need for a glove which cushions the shocks and jarring of ball striking.

Many attempts have been made to cushion these vibrations through the addition of conventional shock absorbing materials to the palm of sports gloves. None of these have succeeded commercially because of their functional problems. To absorb the vibrations, the materials applied have been bulky, heavy, hot to wear and stiff, all factors which inhibit a player's performance and enjoyment. In the past, the shock resistant materials have been composed of synthetic hollow celled foams or other rubber-like materials or gels. In addition to the discomfort associated with these materials there is a substantial loss of feel for the golf glove, bat or racquet which interferes with participation in the sport.

In particular, a golf glove must be very thin and flexible to fit the wearer's hand exactly and to allow a good "feel" of the club. Bulk, thick or stiff materials undermine the utility of the glove. Furthermore, the United States Golf Association sets rules for equipment "legal" for tournament play and any glove with artificially added padding is disqualified. Most golfers, even if not tournament players, want to use conforming equipment. Beyond allowing afflicted players to continue enjoying their sport, a vibration reducing glove can actually help to prevent more damage or injury to the affected tendons or joints.

Golfer's elbow is caused by damage to the tendons connecting the large muscles of the forearm to the small bones of the elbow. In golfing, the leading elbow (the left arm for a right handed golfer), absorbs more vibration than the trailing elbow (the right arm for a right handed golfer), because the lead elbow must be kept straight. A vibration reducing glove on the left hand (or the right hand of a left handed golfer), where gloves are already worn, would reduce much of the harmful vibration.

In addition, many older players suffer from arthritis in their hands and fingers and shy away from firmly gripping their club, racquet or bat which diminishes their performance. With a vibration reducing glove, they are again able to take a firm grip without suffering as much, if any, pain. Accordingly, there is a need for an improved vibration reducing sports glove, which does not inhibit the wearer's performance, which will be legal for tournament play, and maintains a good sense of feel through the glove.

SUMMARY OF THE INVENTION

The invention is generally directed to a vibration reducing sports glove which includes a palm panel of the glove for covering at least the inner surface of a wearer's hand and fingers, a thumb panel for covering the wearer's thumb, secured to the palm panel, a back panel of the glove for covering the outer portion of a wearer's hand and fingers and vibration reducing pad means coupled to at least one of the palm panel and the thumb panel, wherein the vibration reducing pad means includes at least one panel of a natural air-filled hollow interior leather.

The invention is also generally directed to a vibration reducing golf glove constructed in accordance with glove technology with vibration reducing members added in the palm area of the glove, including at least one or more of deer skin, elk skin or moose hide pads affixed to critical shock areas of the glove palm, sewn onto the inside surface of the palm, the deer skin, elk skin or moose hide being tanned in accordance with the same process as the basic glove leather so as to assure compatibility with the glove and texture, feel, stretchability and color so that it does not detract from the golfer's focus in feeling and gripping the glove and breathes freely for comfort.

Accordingly, it is an object of the invention to provide an improved vibration reducing sports glove incorporating tanned deer skin, elk skin or moose hide pads in critical, shock absorbent regions.

Still another object of the invention is to provide an improved vibration reducing sports glove in which thin, shock absorbent tanned leathers are attached to the inside of the palm and thumb of a golf glove so as to significantly improve vibration reduction without negatively affecting the feel of the club through the glove.

Yet another object of the invention is to provide an improved method of assembling a vibration reducing sports glove by tanning the basic outer glove and inner shock resistant pads in accordance with a similar process and then assembling the inner pads to the outer gloves so that flexibility and feel are maintained along with increased vibration reduction.

Yet another object of the invention is to provide an improved sport glove which includes vibration reducing pads at critical locations associated with a particular sport without interfering with the fit or feel of the glove.

Still yet a further object of the invention is to provide an improved vibration reducing glove for use in industrial applications which bring the wearer's hands and arms in contact with shock and vibration over an extended period of time but which require a good sense of feel through the glove and cannot tolerate thick vibration reducing padding.

Yet still a further object of the invention is to provide an improved vibration reducing sport glove which protects the vibration reducing pads between adjacent layers of leather or other material so that the vibration reducing characteristics of the pads are not deteriorated.

Still other objects and advantages of the invention will in part be obvious and will in part be apparent from the specification.

The invention accordingly comprises the features of construction, combinations of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF PREFERRED EMBODIMENTS

Figure 1:
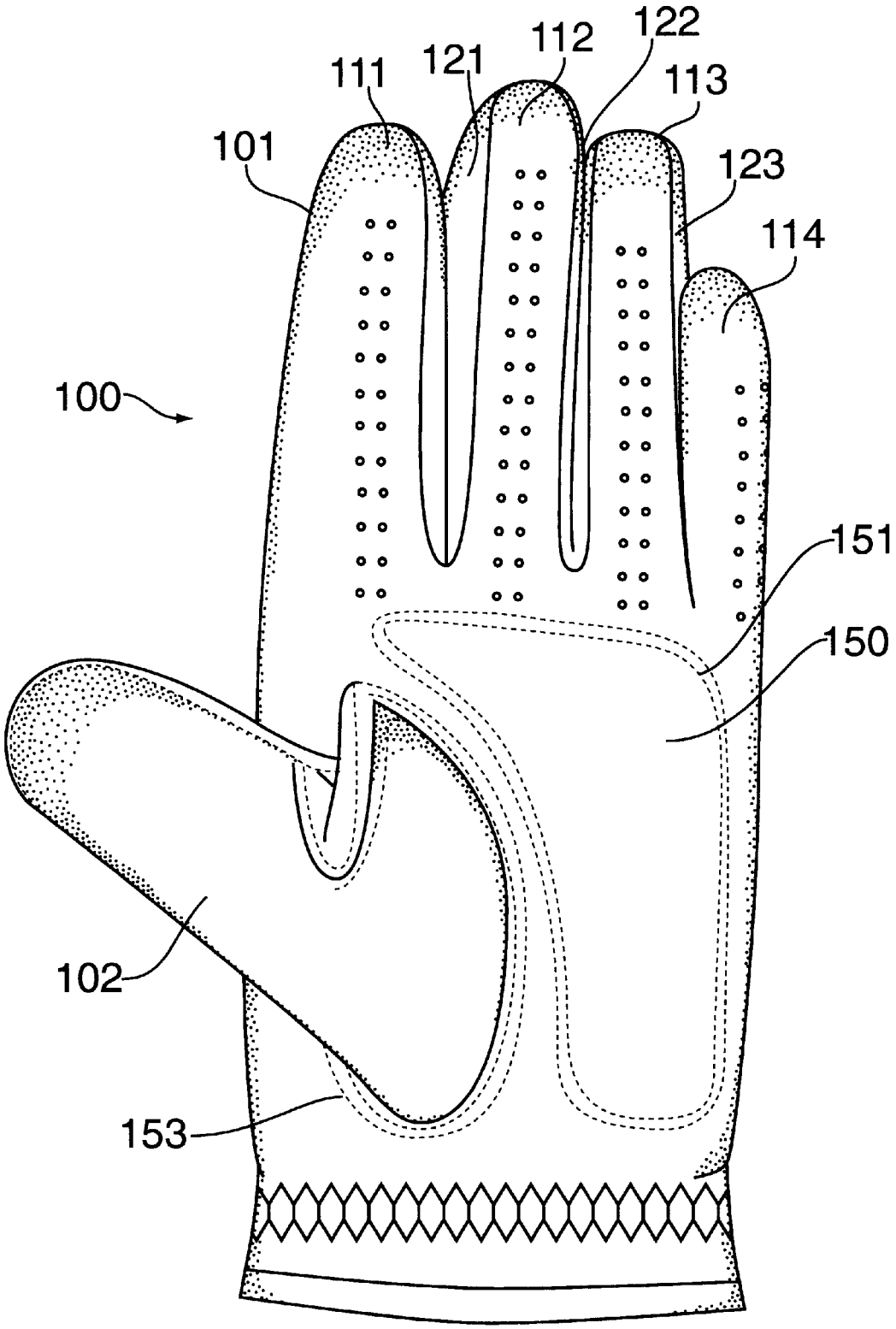
FIG. 1 is a perspective view of the palm side of a vibration reducing golf glove constructed in accordance with a preferred embodiment of the invention.
Figure 2:
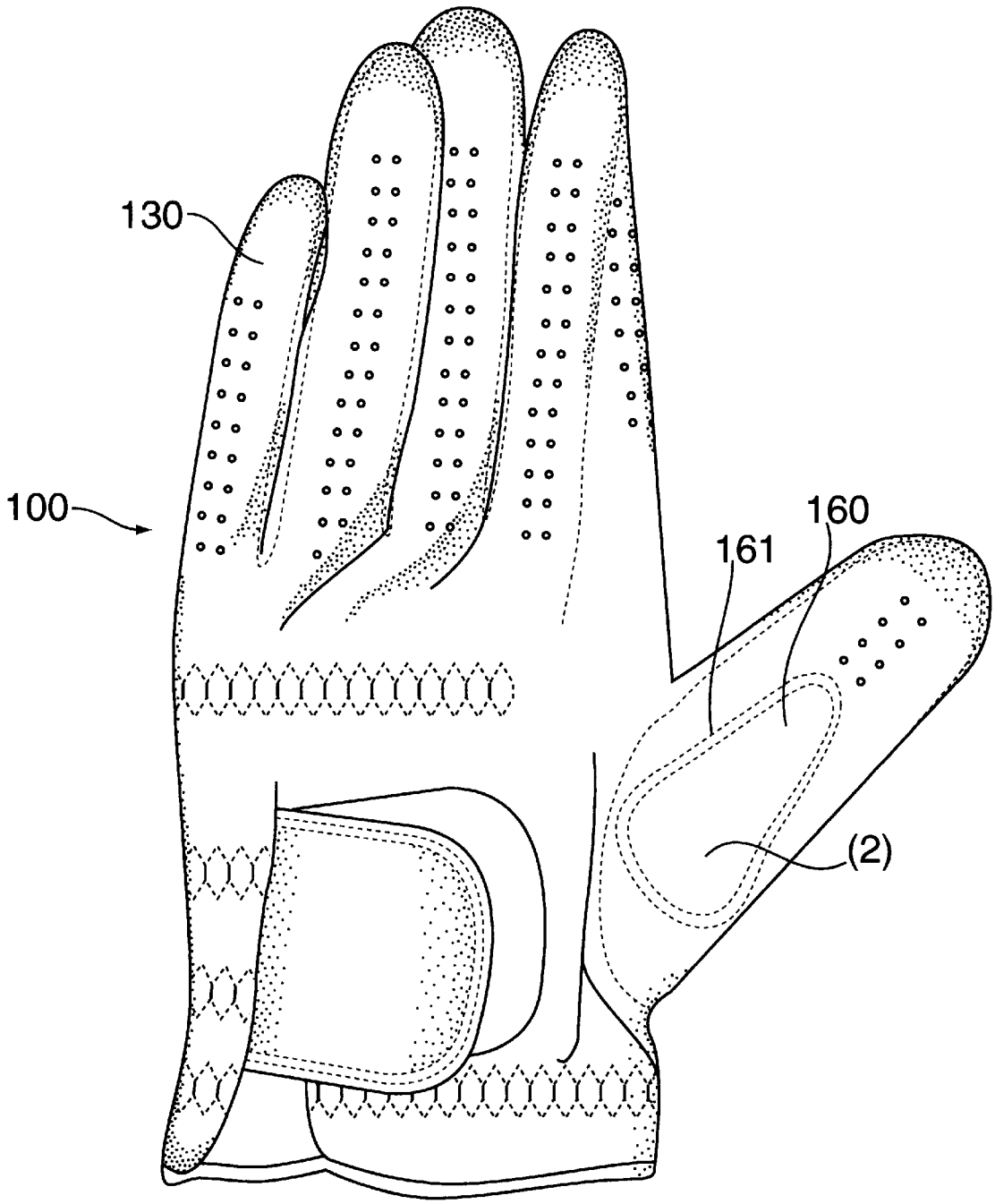
FIG. 2 is a perspective view of the back of a golf glove constructed in accordance with a preferred embodiment of the invention.

Reference is made to FIGS. 1 and 2 wherein the front and back panels 101, 130, respectively, of a glove 100 constructed in accordance with a preferred embodiment of the invention is depicted. Glove 100 includes panel 102 and fingers 111, 112, 113, and 114. In addition, in accordance with golf glove technology, fourchettes 121, 122 and 123, between the fingers are included. Thumb panel 102 is sewn to palm panel 101 with stitching 153 in accordance with conventional glove construction procedures. In addition, as seen in FIG. 2, front portion 101 is sewn to back portion 130 to form a finished glove. Various patterns are regularly used in glove construction and may be incorporated in connection with the invention. In addition, a padding panel 150 is secured to the palm portion 101 of glove 100 by stitching 151. Pad 150 is located in the central palm area of the glove where the greatest amount of stress on the hand is felt in connection with a golf swing. The pad 150 is formed from a type of leather which has an entirely different fiber structure from the soft "gloving" leathers generally used for making sport gloves. Sport gloves are made from cowhide, sheepskin or goat skin. These leathers are very compact by nature, strong and excellent in transmitting an accurate "feel" of a club, bat or racquet. However, because of their compact nature they also have little or no ability to absorb the significant vibrations and shock imparted at the moment of striking a ball at very high velocities, which is the main cause of tendon damage and pain in players. In contrast, deer skin, elk skin and moose hide have entirely different fiber structures than these other "gloving" leathers. Nature evolved the skin structure to insulate these northern animals from the harsh winter conditions they must endure. Deer, elk and moose leather, therefore, has an air filled hollow interior and fluffy fiber structure with excellent vibration and shock absorbing characteristics and properties. However, it does not have sufficient tensile strength, when shaved to the necessary thinness for sport gloves, to be used satisfactorily for an entire glove. A resulting glove made entirely from these leathers would either be too thick to be practical or rip in use.

Also, the grain surface of deer, elk or moose leather, if used as the exterior of a sport glove, would tend to peel and delaminate very quickly. The object of the invention to incorporate the vibration and shock reducing capabilities of deer skin, elk skin or moose skin as underlying sections in key shock areas of sports gloves, thereby enabling players with tendinitis, arthritis or other joint, bone or muscle problems to continue to enjoy their sports without pain or discomfort and to reduce further damage to the afflicted parts. By underlying the basic glove material, the weak nature of the deer skin, elk skin or moose hide is protected. Unlike synthetic shock absorbers, these natural shock absorbers act in concert with the natural leather of the body of the glove, breathe freely for comfort, mold to the player's hand for perfect fit and transmit a good feel of the player's club, bat or racquet.

Pad 160 secured by stitching 161 to the outside thumb 102 is positioned to damp the vibration where the right hand fits over the left hand in a traditional golf grip (2). Alternate locations for sensitive areas can be added as appropriate, even on the fingers.

Figure 3:
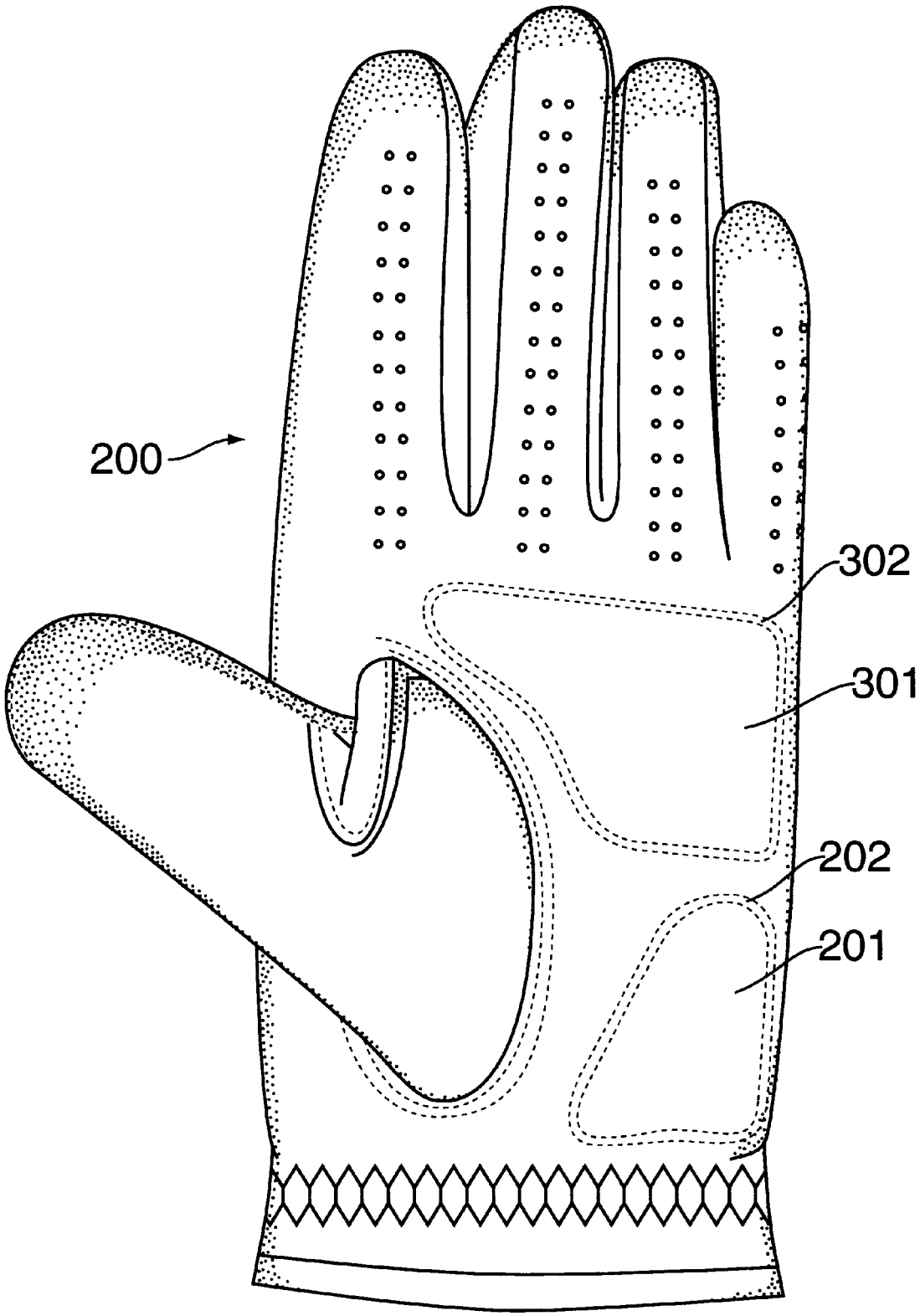
FIG. 3 is a perspective view of the palm side of a golf glove constructed in accordance with another preferred embodiment of the invention.

Reference is next made to FIG. 3 wherein a shock resistant golf glove, generally indicated as 200 constructed in accordance with a preferred embodiment of the invention is depicted. Glove 200 includes four fingers and a thumb and is constructed in accordance with conventional golf glove design and assembly. In addition to the traditional elements of the golf glove, the shock resistant golf glove 100 also includes shock resistant pads fixed in areas 201 and 301. The shock resistant pads are affixed on the inside surface of glove 100 and are stitched to areas 201 and 301 by stitching 202 and 302 shown in FIG. 3. Area 301, which has a shock absorbent pad affixed to the interior underlies the shock area of the club shaft grip. Area 201 which has a pad attached to the interior underlies the shock area of the club grip butt. Thus, as the golf club is gripped by the golfer and cradled between the fingers and the thumb, the handle of the golf club rests up against area 301 and the butt end of the handle nestles against area 201. When the golfer swings the club, accelerating the club as it makes contact with the golf ball, there is a substantial shock or jarring force imparted to the golf club at the head of the golf club. The head is at the opposite end of the golf club from the handle and, in particular, the butt region of the handle. This has the effect of magnifying the effects of the shock at the handle end. Particularly, where the golf ball is not struck cleanly or where the golfer has taken a divot which results in the club head impacting the ground either before, during or after contact with the ball, additional jarring is present.

In a preferred embodiment the pads utilized are made of deerskin. Alternatively, elk skin or moose hide may be used. Deerskin and the other choices cannot be successfully used as the main material of a golf glove because its surface or "grain" is very weak and cannot sustain the frictional contact with the golf club grip. Thus, the deerskin shock pads are applied to the inner surfaces of the glove. Deerskin is extremely soft and even at a reduced thickness of about 0.6 millimeters has great shock resisting characteristics because of its unique hollow fibers which, in nature, insulate the animal from the cold. In preferred embodiments, the deerskin may have differing thicknesses depending upon the degree of shock resistance which is indicated or required. In preferred embodiments a range of 0.2 to 1.5 mm, or more preferably 0.4 to 0.75 mm and even more preferably from 0.4 to 0.6 mm has been found to provide the benefits of shock resistance without negatively influencing flexibility or feel.

The basic glove 100 has a back and a palm portion made of leather or synthetic leather or a combination of the two materials with four finger portions consisting of a palm side and a back side connected by gussets or fourchettes of the same material down their side or of lycra or another expandable material, and a thumb portion or sheath.

Two or more deerskin pads are affixed to critical shock areas of the glove palm, sewn onto the inside surface of the palm. While golf gloves generally are worn only on one hand (the left hand for right handed people and the right hand for left handed people), in severe medical cases which require vibration reduction, or in cold weather, it is preferable to wear two vibration reducing gloves, a left and a right.

In the preferred embodiment the deerskin has been tanned by the same process as the basic glove leather so that it is completely compatible with the glove in texture, feel, stretchability and color so it in no way detracts from the golfers focus in feeling and gripping the glove and it breathes freely for comfort. In a preferred embodiment this includes a combination of chrome and syntans (synthetic tanning agents). The thickness of the deerskin can be kept at a relatively small value so that it does not unduly affect the golfer's feel of the club.

Additional pads can be placed as necessary, particularly in the event that there is an injury. For example, the pads can be placed in a fashion which parallels the contact points of the golf club in the wearer's hand. Likewise, where, for example, an injury to a location exists, such as the lower joint of the index finger, a pad can be inserted to protect against jarring of this joint. Similarly, additional padding can be added to the thumb as shown in FIG. 2, for example, at the base or other portions where required.

Figure 4:
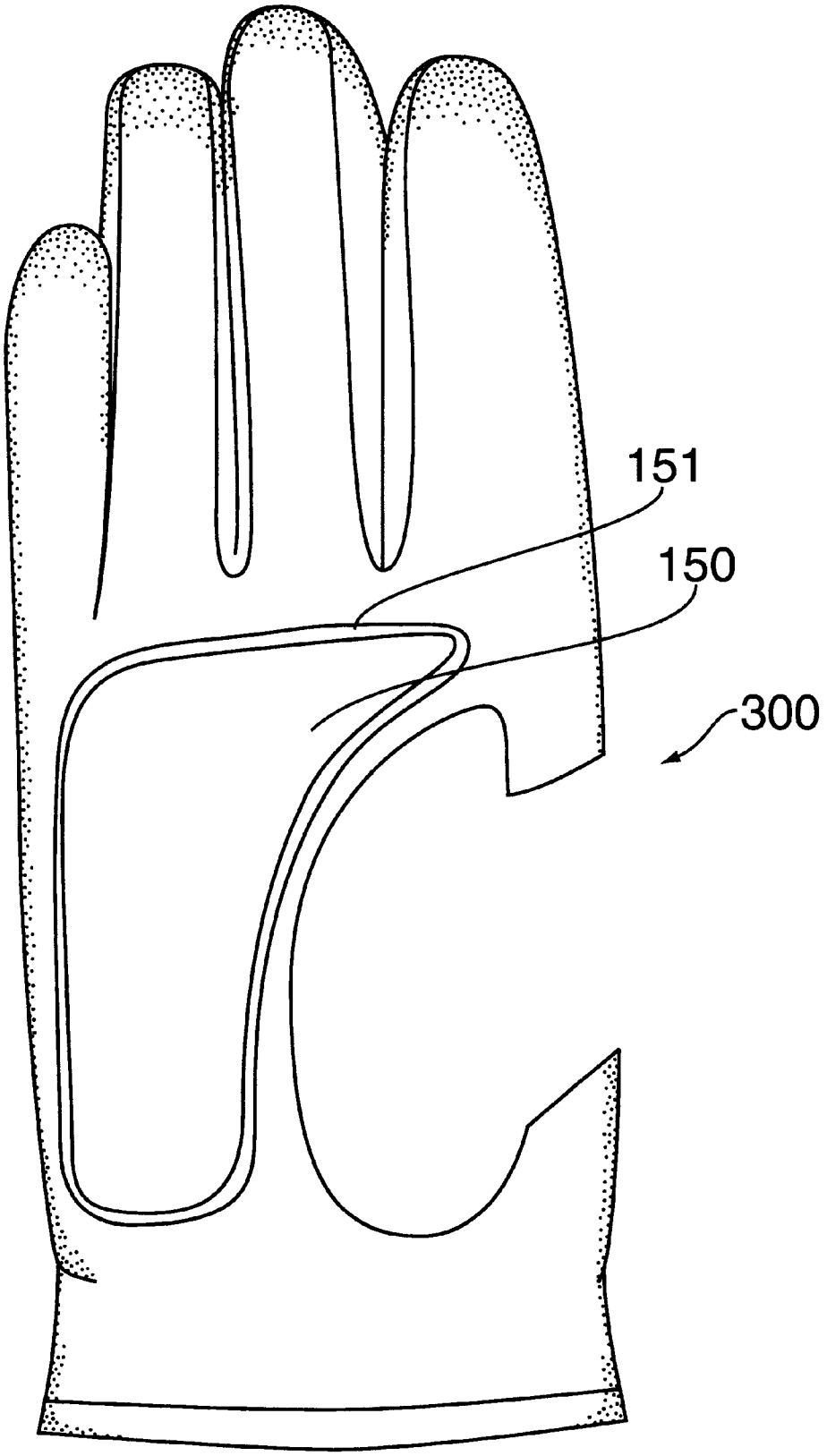
FIG. 4 is a top plan view of the inside of the palm of a glove constructed in accordance with a preferred embodiment of the invention.
Figure 5:
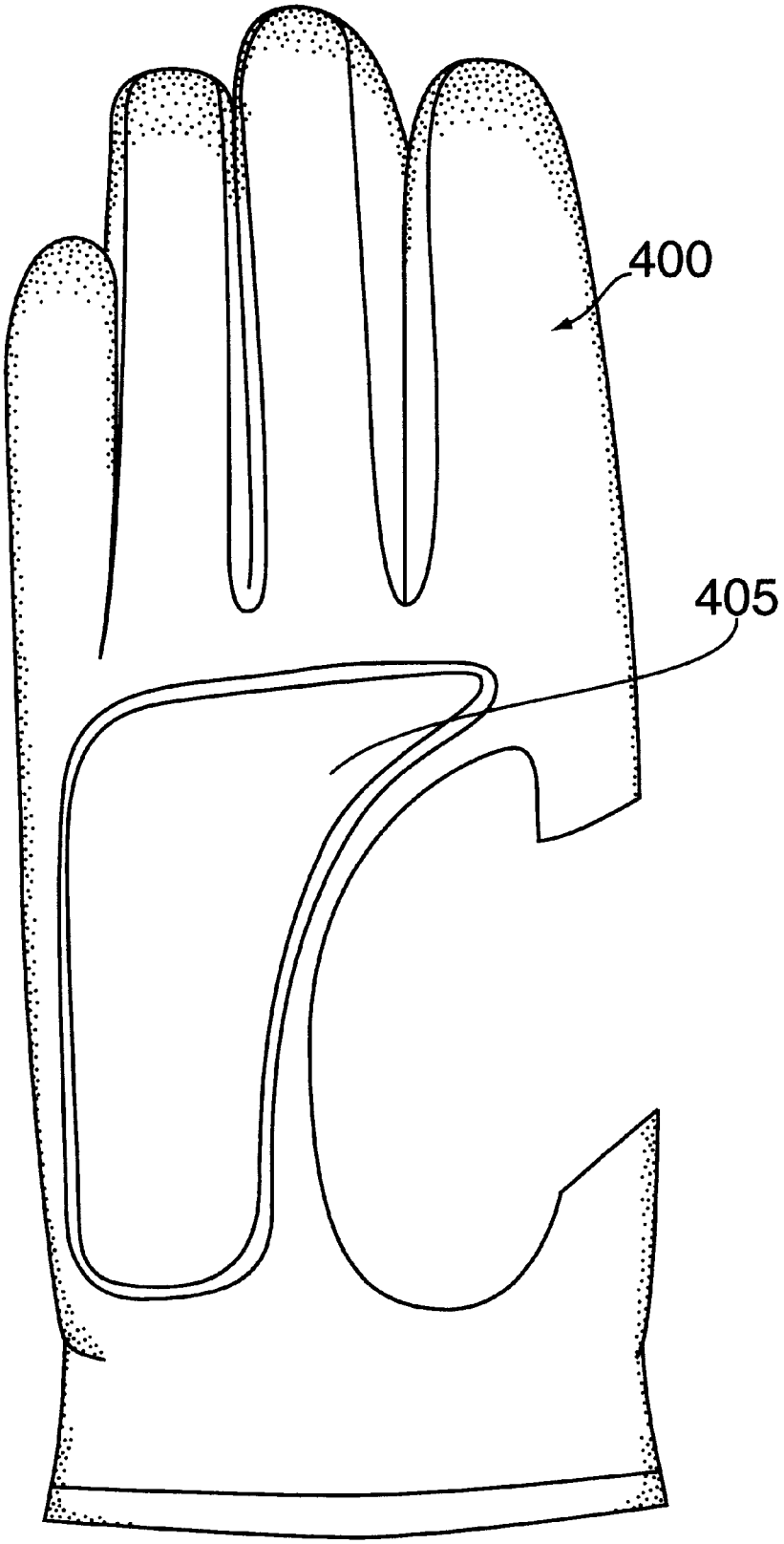
FIG. 5 is a top plan view of the inside of the palm of a glove constructed in accordance with another preferred embodiment of the invention.

The deerskin pad 150 shown in FIG. 4 is sewn to the inside surface of the palm portion of the glove 300 by stitching 151. In this embodiment the deerskin pad would rest against the wearer's palm. As a result of the similar tanning procedures the deerskin pads will have a similar feel. In the embodiment of FIG. 5, which shows the inner surface of glove 400, in accordance with another preferred embodiment of the invention, the deerskin pads are covered with a material 405. Material 405 may be sewn in at the same time as pad 150 or afterwards. The material may either be the same or a similar leather as is used on the rest of the glove or a cloth, such as a terry or tricot material which would absorb moisture and provide a softer feel on the hand. In this way the deerskin pad is also protected from frictional contact which can have the effect of damaging the grain and structure of the deerskin. Material 405 may be the same or slightly larger in size than pad 150. Similar coverings can be used for each pad.

Although the above description has focused on the benefits of the vibration reducing glove technology in a golf glove, this is merely a representative example of the use of the technology. The technology is also useful in connection with baseball batting gloves, tennis, racquetball, squash and other racquet sport gloves, driving gloves, bicycle gloves, football gloves, soccer goalie's gloves, ping pong gloves and other sport gloves. It is also applicable to industrial gloves which are designed for fine work where an accurate and close feel is required, but there is vibration or shock associated with the work. For example, wood craftsmen, when using power equipment, which must be handled with great care and detail, must ordinarily suffer significant vibration to avoid allowing the workpiece from slipping. With a thin glove constructed in accordance with the invention incorporating a deerskin, elk skin or moose hide pad or pads, their grip and feel is unaffected, but the vibration transmitted to their hand is substantially reduced.

Various types of leathers can be used in accordance with the invention, including conventional glove leathers tanned with primary chrome tanning and secondary tanning with syntans including special additives to impart desired characteristics to the leather. The graphite leather gloves manufactured in accordance with U.S. Pat. No. 5,759,706, and sold by Bali Leathers, Inc. under the Graflex® name includes graphite in the fiber of the gloves. The graphite particles provide additional shock and vibration reduction due to the way in which the graphite particles, bonded to the leather fibers, tend to slide laterally to distribute and absorb some of the vibration on the glove. Combined with the deerskin pads in accordance with applicant's invention, a heightened degree of vibration reduction is provided.

Applicant has developed testing in connection with the vibration reducing aspects of the sport glove technology in accordance with the invention. A test has been configured in which the leather is placed on a particularly hard, stable surface, such as marble or granite, and a steel ball bearing is dropped from a standardized height onto the leather. To the extent that there is little or no vibration reduction by a panel of the glove the ball bearing would be expected to rebound to a height equivalent to the height it would bounce up to in the absence of any glove panel on the hard surface. In contrast, where the glove panel incorporating the vibration reducing pads in accordance with the invention are placed on the hard surface and the ball bearings are dropped from the standard height, one would expect a reduction in rebound height to correspond with a degree of vibration reduction. This is because a portion of the impact energy of the ball bearing is absorbed and distributed by the vibration reducing pads. In addition, to the extent that the downward force of the ball bearing is not only stopped but accelerated upwardly, the force exerted on the wearer's hand would correspond to the sum of the force that the ball bearing had when it contacted the glove panel and the force required to redirect the ball bearing upward, away from the panel. Where the ball bearing rebounds to a lesser height the total force supplied by the glove (and, in fact, by the hand behind the glove which supports the glove panel) is therefore reduced. In testing it was found that there was a significant and substantial reduction of the rebound height of a steel ball bearing when dropped from a standardized height onto a glove panel including a vibration reducing pad constructed in accordance with a preferred embodiment of the invention as compared to a standard leather glove without such vibration reduction technology. Accordingly, there is clear evidence that the vibration reducing pads placed at critical points of contact actually reduced the force transmitted to the wearer's hand whether vibration, shock or other transient force.

Accordingly, an improved vibration reducing sport glove incorporating improved vibration reducing pads at critical locations, which do not interfere with the feel and wear of the glove, is provided.

It will thus be seen that the objects set forth above, among those made apparent in the preceding description, are efficiently obtained and, since certain changes may be made in the above constructions without departing from the spirit and scope of the invention, it is intended that all matter contained in the above description or shown in the accompanying drawings shall be interpreted as illustrative, and not in a limiting sense.

It is also to be understood that the following claims are intended to cover all of the generic and specific features of the invention, herein described and all statements of the scope of the invention which, as a matter of language, might be said to fall therebetween.

What is claimed is:

1. A vibration reducing sports glove, comprising:

a palm panel of the glove, for covering the inner portion of a wearer's hand and fingers;

a thumb panel of the glove for covering the wearer's thumb, coupled to palm panel;

a back panel of the glove for covering the outer portion of a wearer's hand and fingers;

vibration reducing pad means, coupled to the interior of the palm portion in critical locations, for reducing the degree of vibration wherein the vibration reducing pad means are formed from one or more of deer, moose or elk skins;

whereby the vibration reducing sports glove provides a reduction in the vibration and shock transmitted to the wearer's hand at the time a shock or vibration is applied to the outer surface of the glove.

2.The vibration reducing sports glove of claim 1 wherein the palm panel, thumb panel and back panel of the glove is formed from a leather tanned in accordance with a tanning process.

3. The vibration reducing sports glove of claim 2 wherein the vibration reducing pad means is formed of deer, elk or moose skin tanned in accordance with the process used for tanning the leather used in the palm panel, thumb panel and back panel.

4. The vibration reducing sports glove of claim 1 wherein the vibration reducing pad means is sewn around its perimeter to the inside surface of the palm portion.

5. The vibration reducing sports glove of claim 4 wherein the palm, thumb and back panels are formed from a light weight synthetic leather with deer, elk or moose leather inner pads as the vibration reducing means.

6. The vibration reducing sports glove of claim 1 wherein the vibration reducing pad means also includes pads of deer, elk or moose skins having a thickness.

7. The vibration reducing sports glove of claim 6 wherein the vibration reducing pads are also secured to critical locations on the inside surface of the thumb panel.

8. The vibration reducing sports glove of claim 6 wherein the vibration reducing pads are also secured to critical locations on the inside surface of the back panel.

9. The vibration reducing sports glove of claim 1 further including pad covering means extending over at least a portion of the vibration reducing pad means for assuring that physical contact between the wearer's hand and fingers and the vibration reducing pad means is reduced.

10. The vibration reducing sports glove of claim 1 wherein the thickness of the vibration reducing pad means is between 0.2 and 1.5 mm.

11. The vibration reducing sports glove of claim 1 wherein the thickness of the vibration reducing pad means is between 0.4 and 0.6 mm.

12. The vibration reducing sports glove of claim 1 wherein the palm panel, thumb panel and back panel are formed of a synthetic leather and the vibration reducing pad means include deer, elk or moose leather inner pads.

13. The vibration reducing sports glove of claim 1 wherein the glove is a golf glove having pads covering a substantial portion of the palm of the glove.

14. The vibration reducing sports glove of claim 13 wherein the vibration reducing pad means also includes a pad covering a portion of the back of the wearer's thumb covered by the other hand in a traditional golf grip.

15.The vibration reducing sports glove of claim 1 wherein the palm panel, thumb panel and back panel are formed of a graphite impregnated leather and the vibration reducing pad means include deer, elk or moose leather inner pads.

16. A vibration reducing glove, comprising:

a palm panel of the glove, for covering the inner portion of a wearer's hand and fingers;

a thumb panel of the glove for covering the wearer's thumb, coupled to palm panel;

a back panel of the glove for covering the outer portion of a wearer's hand and fingers;

vibration reducing pad means, coupled to the interior of the palm portion in critical locations, for reducing the degree of vibration wherein the vibration reducing pad means are formed from one or more of deer, moose or elk skins;

whereby the vibration reducing glove provides a reduction in the vibration and shock transmitted to the wearer's hand at the time a shock or vibration is applied to the outer surface of the glove.

17. The vibration reducing glove of claim 16 wherein the thickness of the vibration reducing pad means is between 0.2 and 1.5 mm.

18. The vibration reducing sports glove of claim 16 wherein the thickness of the vibration reducing pad means is between 0.4 and 0.6 mm.

* * * * *